US006681894B1

(12) United States Patent
Fanguy

(10) Patent No.: US 6,681,894 B1
(45) Date of Patent: Jan. 27, 2004

(54) PORTABLE WELL HEAD WORK PLATFORM

(76) Inventor: Robert P. Fanguy, 3507 Captain Cade Rd., Broussard, LA (US) 70518

( * ) Notice: Subject to any disclaimer, the term of this patent is extended or adjusted under 35 U.S.C. 154(b) by 0 days.

(21) Appl. No.: 10/280,707

(22) Filed: Oct. 26, 2002

(51) Int. Cl.[7] ..... E04G 1/16; E04G 1/18; E04G 1/36

(52) U.S. Cl. ..... 182/113; 182/142; 182/128

(58) Field of Search ..... 182/113, 128, 182/142, 141; 405/196, 195.1, 204; 114/264, 365

(56) References Cited

U.S. PATENT DOCUMENTS 4,152,926 A 5/1979 Hasha
5,074,382 A * 12/1991 Do ..... 182/142
5,122,010 A * 6/1992 Burguieres et al. ..... 405/204
5,180,012 A 1/1993 Crawford
5,950,737 A * 9/1999 Chou et al. ..... 405/195.1
6,158,516 A 12/2000 Smith et al.
6,591,775 B2 * 7/2003 Robinson ..... 114/365

* cited by examiner

*Primary Examiner*—Alvin Chin-Shue
*Assistant Examiner*—Hugh B. Thompson
(74) *Attorney, Agent, or Firm*—Robert N. Montgomery

(57) ABSTRACT

A portable work platform or basket adaptable to wellhead valve flanges at a point above the blowout preventors thereby providing 360-degree personnel access to the wellhead during work-over and snubbing operations. The platform includes handrails, kick plates and an assortment of pipe flange adaptors for coupling to a variety of wellhead configurations. The platform further includes a pivotal arm for attaching a retractable personnel tether reel or a pulley block for a wench cable.

16 Claims, 4 Drawing Sheets

PORTABLE WELL HEAD WORK PLATFORM

1. FIELD OF THE INVENTION

This invention relates generally to temporary work platforms for oil and gas wells and more particularly to the adaptation of such work platforms directly to the well head for special operations such as removal and installation of coiled tubing, snubbing, injection and other service operations.

2. GENERAL BACKGROUND

There exists in the oil and gas industry a procedure known as "snubbing" in which a string of pipe is forced into a well bore under pressure for various reasons, In such cases, the well bore usually has been drilled and a certain amount of casing has been set and blowout preventors or other ram apparatus have been installed at the wellhead to seal around the drill pipe or other pipe strings being inserted into the well bore. These blowout preventors and ram-type apparatus seal around the string of pipe being snubbed into the well under pressure to prevent the pressurized fluid from escaping around the outside of the string of pipe. The connections between the various pipe segments, including downhole tools, are made-up and snubbed into the well, and are usually immediately subjected to high external pressures. A leak in a connection creates a very hazardous working condition for all personnel involved as high-pressure fluids or gas may flow from the inside of the well bore, through the leak, upwardly through the string of pipe being snubbed into the well, and out onto the workmen. There also exists in the oil and gas industry a procedure known as the work-over of a well in which a string of pipe is forced into a previously drilled well. The well is "live", that is, it contains fluid under pressure below a certain depth but because of some obstruction, such as sand or concrete or the like, contains little or no pressurized fluid above that depth. When the downhole tool on the end of the string of pipe breaks through the obstruction, the entire drill string, including the connections between the segments, is subject to the pressures of the well and such pressures can be intense. The same problems described above with respect to snubbing pipe into a completely live well are applicable to this work-over procedure. It is intended that the improved apparatus shall be applicable to such a work-over procedure and, as such, as used herein, the word snubbing shall include not only inserting a string of pipe into a completely live well but also inserting a string of pipe into a well under circumstances in which the possibility exists that the string of pipe may be subjected to pressurized fluids. It is an object of this invention to provide a safe work platform adaptable to the well head in a manner whereby the workers have access to all sides of the tubing injector through which a string of coiled tubing being snubbed into a well under pressure is forced, thereby reducing hazardous working conditions.

It is an additional object of this invention to provide an improved method and apparatus for personnel safety while snubbing a string of pipe into a well under pressure with a tubing injection apparatus whereby the apparatus is inserted in the wellhead piping above the blowout preventors or other ram-safety apparatus so that the connections between the pipe segments comprising the string of pipe may be inserted centrally through the work platform in a safe and efficient manner.

Still a further object of the invention is to provide a portable work platform centrally adaptable to a wellhead valve flange in a manner that provides unobstructed 360 degree access to the well bore and in a manner whereby a plurality of workers has access to the well head from the work platform and at least one of the workers is tethered to the platform at all times.

Yet another object of the invention is to provide a portable adaptor platform attached to and surrounding the well head that provides a secure place for hanging downhole tools, subsections, etc.

The invention itself, as well as additional objects and advantages thereof, will become readily apparent from the following description in connection with the accompanying drawings, in which like numerals represent like parts.

3. SUMMARY OF THE INVENTION

A portable work platform or basket adaptable to wellhead valve flanges at a point above the blowout preventors thereby providing 360-degree-personnel access to the wellhead during work-over and snubbing operations. The platform includes handrails, kick plates and an assortment of pipe flange adaptors for coupling to a variety of wellhead configurations. The platform further includes a pivotal arm for attaching a retractable personnel tether reel or a pulley block for a wench cable.

4. BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

Figure 4:
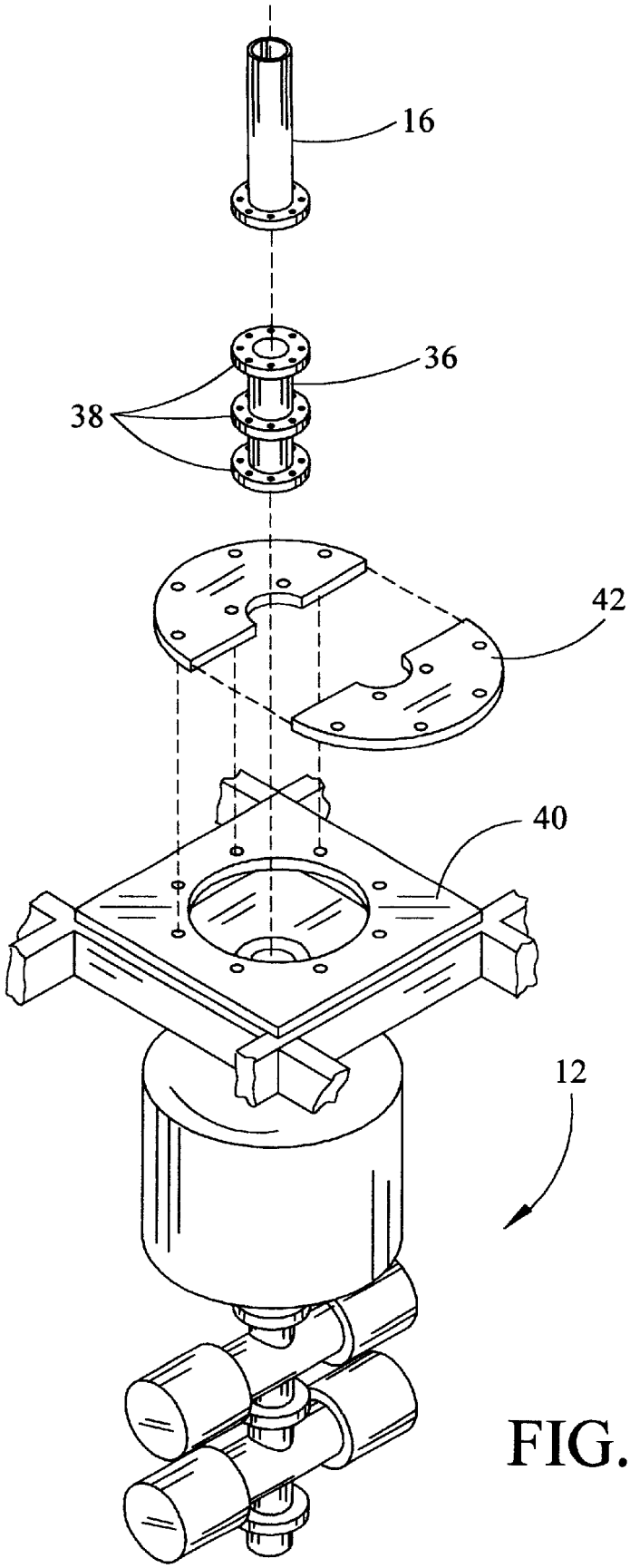
FIG. 4 is an expanded view of the platform connection components.
Figure 4A:
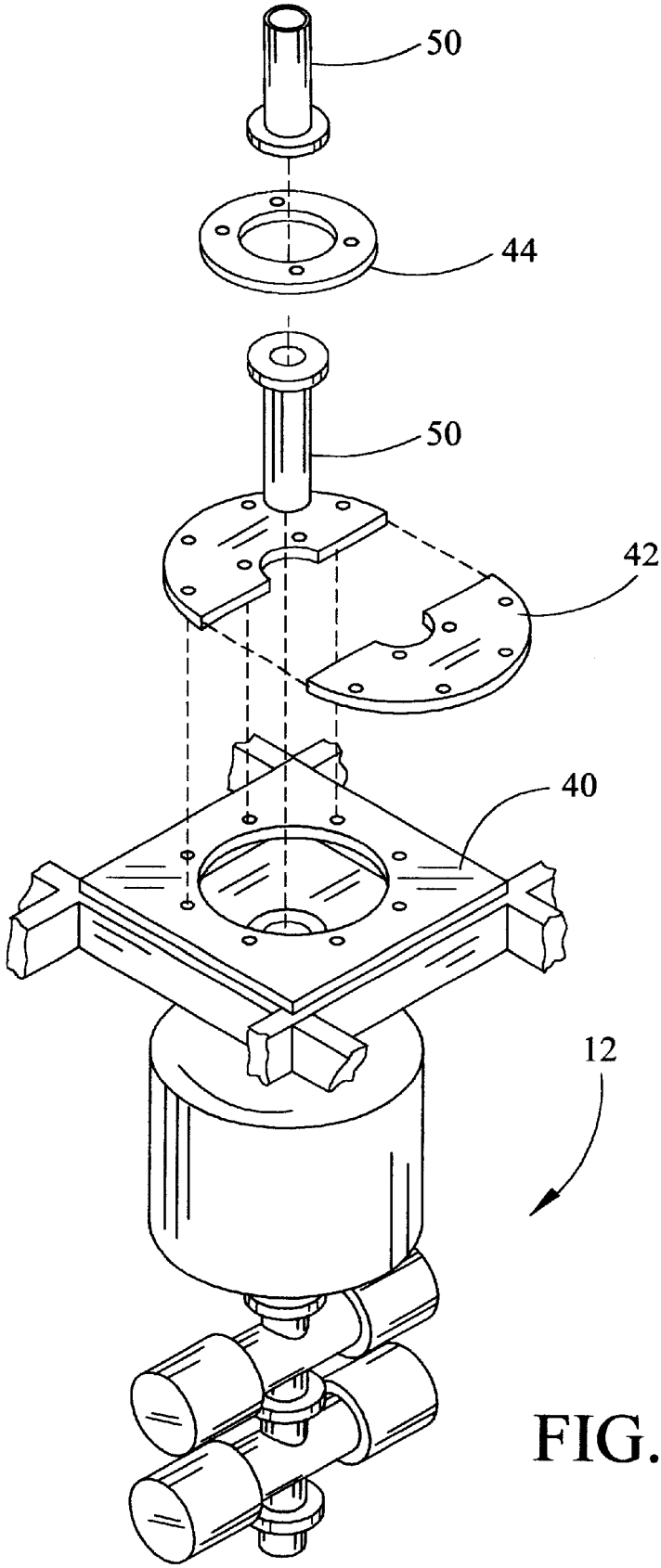

FIG. 4*a* is an expanded view of the platform connection components for welded joint pipe..

5. DETAILED DESCRIPTION OF THE PREFERRED EMBODIMENT

Figure 1:
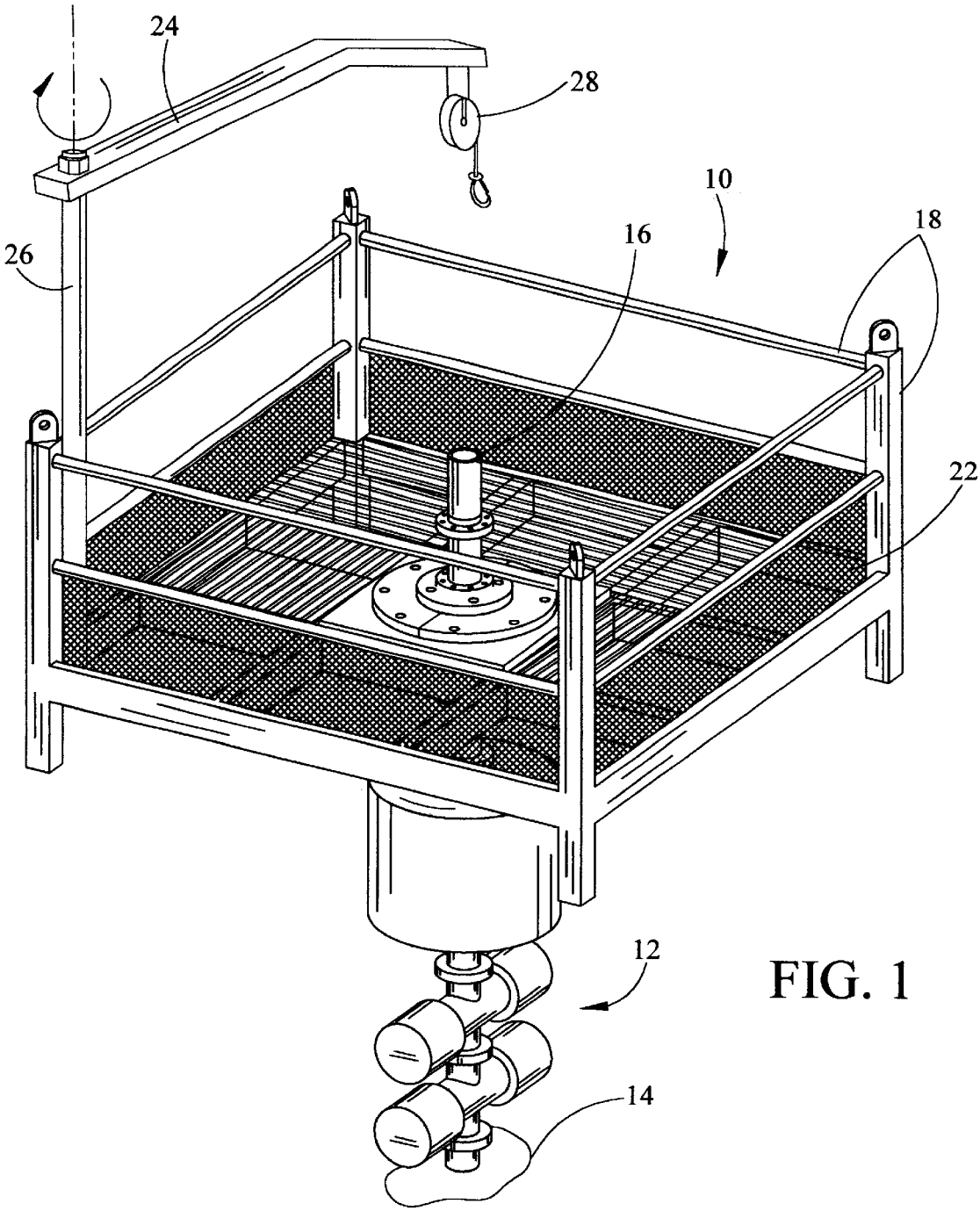
FIG. 1 is an isometric view of the work platform attached to a wellhead.
Figure 2:
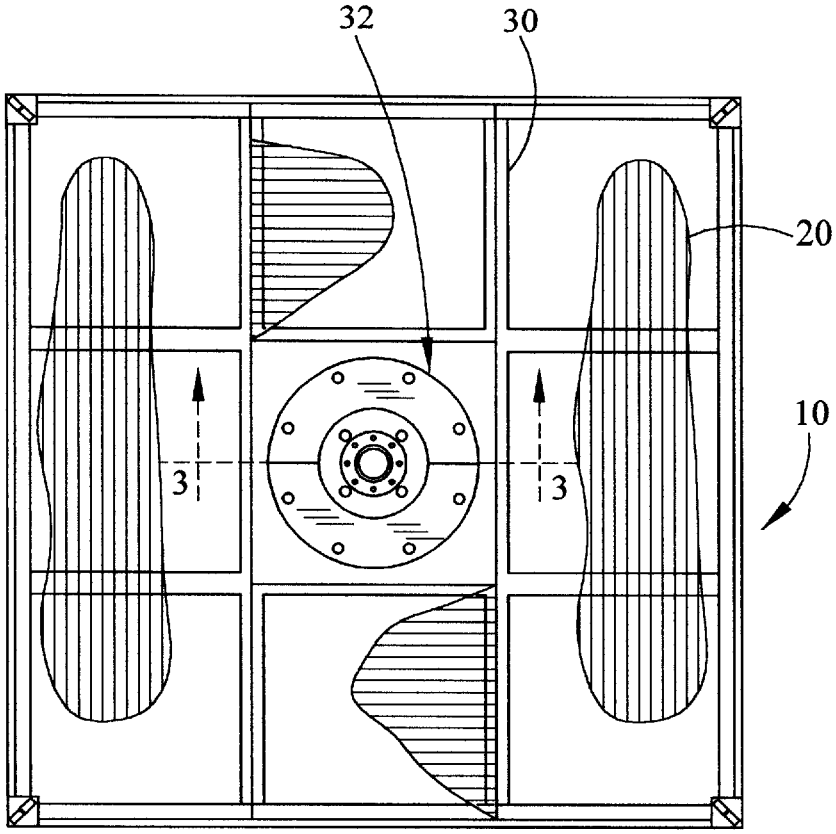
FIG. 2 is a top view of the platform attachment.

The wellhead work platform or basket assembly 10 is shown in FIG. 1 centrally attached to the wellhead at a point above the well's blowout preventors and shut-in valve assembly 12, sometimes called the tree, thereby suspending the platform 10 well above ground or water level 14. In many cases unmanned wellheads are provided with very little or no structure for personnel to perform routine service or work-over operations. Personnel are often required to climb atop the wellhead valve assembly to perform such routine maintenance operations. It is, therefore, advantageous to provide a means for attaching a portable work platform directly to the wellhead 12 in a manner whereby the workers are provided with 360-degree access to the wellhead when accessing a live tubing string 16. The platform or basket assembly 10 is constructed of structural tubing including handrails and comer post 18, bar grating floor members 20 seen in FIG. 2 and wire mesh, expanded metal or wire screen kick plates 22. The comer posts are provided with lifting eyes to facilitate lifting the platform into position. A pivotal davit 24 is provided, supported by a column 26 located in one comer of the platform assembly 10 and is provided with a retractable personnel safety lanyard assembly 28. Looking again at FIG. 2 we see that the platform assembly 10 includes a structural frame 30 forming a grid emanating outwards from a central mounting flange assembly 32, thus forming the base support for the bar grating, 20 comer post, and hand rails 18.

Figure 3:
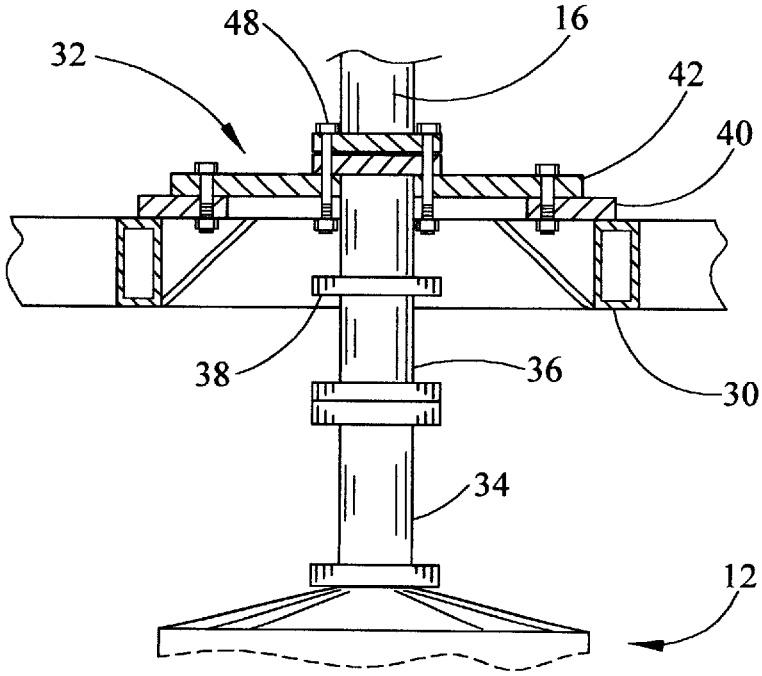
FIG. 3 is a cross section view taken along sight lines 3—3 seen in FIG. 2.

In most cases the wellhead valve assembly 12 is fitted with a flanged fitting 34 that is used for connecting additional fittings, pipe, tubing, etcetera, as seen in FIG. 3. Attachment of the portable work platform 10 to the wellhead is achieved by attaching a cooperative flanged tubular fitting adapter 36 to the wellhead fitting 34. The adapter fitting 36 may also be a reducing sub or have several adaptor flanges 38 located at intervals along the exterior of the fitting 36. At least one of these flanges 38 is utilized for attaching the platform flange assembly 32. The platform flange assembly 32 is composed of a base or fixed flange plate 40 centrally attached to the center of frame grid 30 and having a sufficiently large opening therein for passing the flanges located on fittings 34 and 36 if necessary. The platform 10 should be located as close to the wellhead valve assembly 12 as possible. The flange assembly 32 further includes a split flange plate 42 removably attached to the fixed flange plate 40, an internal diameter and bolt circle of which is cooperative with at least one of the flanges 38 on the adaptor fitting 36 as seen in the exploded view in FIG. 4. The split flange 42 surrounds and captures the adapter sub 36 just below the one of the flanges 38 and is then bolted thereto with fasteners 48. Pipe or tubing 16 may then be attached to the adaptor sub 36 with the fasteners 48 passing through both the pipe flanges and the split flange 42 as shown in FIG. 3. In cases where welded flange pipes 50 are used in the tubing or pipe string, as illustrated in FIG. 4, a weld collar or flange ring 44 having bolt holes therein is used to expand the pipe joint flange diameter so as to be cooperatively fastened to the split flange 42.

Because many different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A portable wellhead personnel work platform for adaptor connection to a wellhead valve assembly comprising:

a) a base structure forming a grid extending outwardly from a central mounting location;

b) a grating attached to said base structure;

c) a railing attached perpendicularly to and surrounding said base structure, at least a portion of said railing having kick plates attached thereto;

d) a flange mounting assembly centrally attached to said base structure; and e) an adaptor means for removably fastening said flange-mounting assembly to a wellhead valve assembly.

2. The portable wellhead personnel work platform according to claim 1 wherein said platform further includes a pivotal davit for attaching a personnel safety lanyard.

3. The portable wellhead work platform according to claim 1 wherein said railing includes corner post having lifting eyes located at one end.

4. The portable wellhead work platform according to claim 1 wherein said flange mounting assembly comprises a support plate having a relatively large opening centrally located therein and a plurality of bolt holes.

5. The portable wellhead work platform according to claim 4 wherein said adaptor means is a tubular sub-section adapted for connection to a wellhead valve assembly, said tubular sub-section having a plurality of flanges, each having a plurality of bolt holes therein.

6. The portable wellhead work platform according to claim 5 wherein said mounting assembly further comprises a split flange plate having two half portions, each said half portion having a semicircular central opening, a plurality of bolt holes adjacent said semicircular central opening corresponding to said bolt holes located in at least one of said plurality of flanges attached to said tubular sub section and a plurality of bolt holes located and arranged to correspond with said plurality of bolt holes in said support plate.

7. The portable wellhead work platform according to claim 1 wherein said adaptor means is a weld flange having a central opening therein corresponding to a major diameter of a tubular welded flange connection and a plurality of holes therein adjacent said opening corresponding to said plurality of holes adjacent said semicircle in said split flange plate.

8. The portable wellhead work platform according to claim 1 wherein said work platform provides unobstructed 360-degree access to said wellhead valve assembly.

9. The portable wellhead work platform according to claim 1 wherein said portable wellhead work platform is totally supported by said adaptor means.

10. A portable personnel work platform for attachment to a wellhead valve assembly comprising:

a) a base frame structure having floor grating, perimeter hand railing extending perpendicular to said base frame structure and a means for lifting said base frame structure;

b) an adaptor means for attachment to said wellhead valve assembly; and c) a mounting plate assembly centrally attached to said base frame structure, said mounting plate assembly comprising a fixed plate and a removable split flange plate for further attachment to said adaptor means.

11. The portable personnel work platform according to claim 10 wherein said adaptor means is a tubular sub-section having a plurality of flanges, each of said flanges having a plurality of fastener holes.

12. The portable personnel work platform according to claim 10 in which said adaptor means is a single weld-flange having a plurality of fastener holes therein, said weld-flange centrally bored to coincide with the major diameter of a welded flange joint connection extending vertically from said well head valve assembly.

13. The portable personnel work platform according to claim 10, said work platform further comprises a pivotal davit and a retractable personnel safety lanyard.

14. A method for servicing an oil and gas well comprising the steps of:

a) providing a portable personnel work platform attachable directly to a well head valve assembly at a point above the blowout preventors and shut-in valves comprising:

i) a base frame structure having floor grating, perimeter hand railing extending perpendicular to said base frame structure, and a means for lifting said base frame structure;

ii) an adaptor means for attachment to said wellhead valve assembly; and iii) a mounting plate assembly centrally attached to said base frame structure, said mounting plate assembly comprising a fixed plate and a removable split flange plate for further attachment to said adaptor means; and b) attaching said adaptor means to a flange located atop said wellhead valve assembly;

c) lifting and positioning said portable personnel work platform centrally around said adaptor means; and d) securing said split flange plate to said adaptor means and said fixed plate.

15. The method according to claim 14 further comprising the step of providing a plurality of alternative adaptor means and selectively choosing the most suitable depending on wellhead flange configuration.

16. The method according to claim 14 further comprising the step of providing said personnel platform with a pivotal davit having a retractable personnel safety tether.

* * * * *

US006681894C1

(12) EX PARTE REEXAMINATION CERTIFICATE (8501st)

United States Patent

Fanguy

(10) Number: US 6,681,894 C1

(45) Certificate Issued: Aug. 30, 2011

(54) PORTABLE WELL HEAD WORK PLATFORM

(76) Inventor: Robert P. Fanguy, Broussard, LA (US)

Reexamination Request:
No. 90/009,664, Feb. 24, 2010

Reexamination Certificate for:

| | |
|---|---|
| Patent No.: | **6,681,894** |
| Issued: | **Jan. 27, 2004** |
| Appl. No.: | **10/280,707** |
| Filed: | **Oct. 26, 2002** |

(51) Int. Cl.

| | |
|---|---|
| ***E04G 1/15*** | (2006.01) |
| ***E04G 1/18*** | (2006.01) |
| ***E04G 1/36*** | (2006.01) |

(52) U.S. Cl. ..... 182/113; 182/142; 182/128

(58) Field of Classification Search ..... 182/113
See application file for complete search history.

(56) References Cited

U.S. PATENT DOCUMENTS

| | | | |
|---|---|---|---|
| 335,164 | A | 2/1886 | Vitalis |
| 3,215,203 | A | 11/1965 | Sizer |
| 4,074,539 | A | 2/1978 | Guild et al. |
| 4,085,796 | A | 4/1978 | Council |
| 4,251,176 | A | 2/1981 | Sizer et al. |
| 4,515,220 | A | 5/1985 | Sizer et al. |
| 6,848,539 | B2 | 2/2005 | Lee et al. |

OTHER PUBLICATIONS

Neal Adams, Workover Well Control, 1981, pp. 203–206, PennWell Publishing Company, Tulsa, Oklahoma.

William E. Jackson, Casing and Cementing, 2001, p. 6, Third Edition, Petroleum Extension Service, Houston, Texas.

*Primary Examiner*—William C Doerrler

(57) ABSTRACT

A portable work platform or basket adaptable to wellhead valve flanges at a point above the blowout preventors thereby providing 360-degree personnel access to the wellhead during work-over and snubbing operations. The platform includes handrails, kick plates and an assortment of pipe flange adaptors for coupling to a variety of wellhead configurations. The platform further includes a pivotal arm for attaching a retractable personnel tether reel or a pulley block for a wench cable.

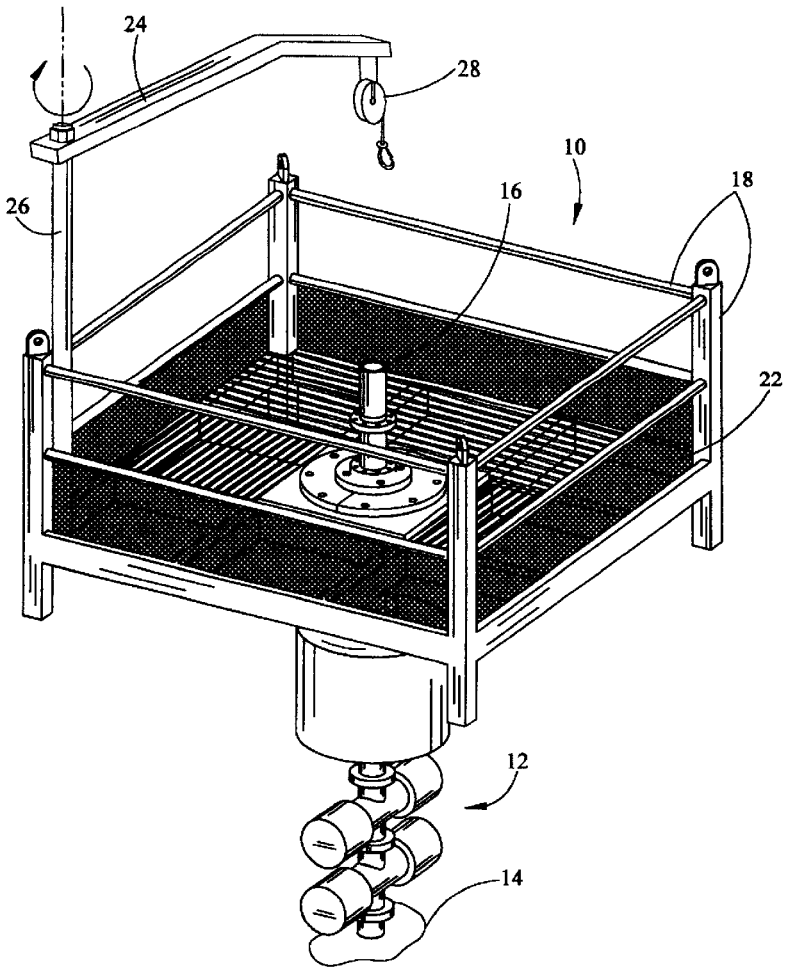

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 6, 7, 10, 14 and 15 are determined to be patentable as amended.

Claims 2-5, 8, 9, 11-13 and 16, dependent on a amended claim, are determined to be patentable.

New claims 17-20 are added and determined to be patentable.

1. A portable wellhead personnel work platform for adaptor connection to a wellhead valve assembly comprising:

a) a base structure forming a grid extending outwardly from a central mounting location;

b) a grating attached to said base structure;

c) a railing attached perpendicularly to and surrounding said base structure, at least, a portion of said railing having kick plates attached thereto;

d) a flange mounting assembly centrally attached to said base structure; and e) an adaptor means for removably fastening said flange mounting assembly to a wellhead valve assembly, *wherein the adaptor means is directly mounted to the flange mounting assembly and the wellhead valve assembly*.

6. [The portable welhead work platform according to claim 5] *A portable wellhead personnel work platform for adaptor connection to a wellhead valve assembly comprising:*

*a) base structure forming a grid extending outwardly from a central mounting location;*

*b) a grating attached to said base structure;*

*c) a railing attached perpendicularly to and surrounding said base structure, at least a portion of said railing having kick plates attached thereto;*

*d) a flange mounting assembly centrally attached to said base structure, wherein said flange mounting assembly comprises a support plate having a relatively large opening centrally located therein and a plurality of bolt holes;*

*e) an adaptor means for removably fastening said flange mounting assembly to a wellhead valve assembly, wherein said adaptor means is a tubular sub-section adapted for connection to a wellhead valve assembly, said tubular sub-section having a plurality of flanges, each having a plurality of bolt holes therein; and*

*f)* wherein said mounting assembly further comprises a split flange plate having two half portions, each said half portion having a semicircular central opening, a plurality of bolt holes adjacent said semicircular central opening corresponding to said bolt holes located in at least one of said plurality of flanges attached to said tubular sub section and a plurality of bolt holes located and arranged to correspond with said plurality of bolt holes in said support plate.

7. The portable wellhead work platform according to claim [1] *6* wherein said adaptor means is a weld flange having a central opening therein corresponding to a major diameter of a tubular welded flange connection and a plurality of holes therein adjacent said opening corresponding to said plurality of holes adjacent said semicircle in said split flange plate.

10. A portable personnel work platform for attachment to a wellhead valve assembly comprising:

a) a base frame structure having floor grating, perimeter hand railing extending perpendicular to said base frame structure and a means for lifting said base frame structure;

b) an adaptor means for attachment *directly* to said wellhead valve assembly; and c) a mounting plate assembly centrally attached to said base frame structure, said mounting plate assembly comprising a fixed plate and a removable split flange plate for further attachment *directly* to said adaptor means.

14. A method for servicing an oil and gas well comprising the steps of:

a) providing a portable personnel work platform attachable directly to a well head valve assembly at a point above the blowout preventors and shut-in valves, *said well head valve assembly having flanged fittings*, comprising:

i) a base frame structure having floor grating, perimeter hand railing extending perpendicular to said base frame structure, and a means for lifting said base frame structure;

ii) [an] *a flanged* adaptor means for attachment to said wellhead valve assembly; and iii) a mounting plate assembly centrally attached to said base frame structure, said mounting plate assembly comprising a fixed plate and a removable split flange plate for further attachment to said adaptor means; and b) attaching said adaptor means *directly* to a flange located atop said wellhead valve assembly;

c) lifting and positioning said portable personnel work platform centrally around said adaptor means; and d) securing said split flange plate to said adaptor means and said fixed plate.

15. [The method according to claim 14 further comprising the step of] *A method for servicing an oil and gas well comprising the steps of:*

*a) providing a portable personnel work platform attachable directly to a well head valve assembly at a point above the blowout preventors and shut-in valves comprising:*

*i) a base frame structure having floor grating, perimeter hand railing extending perpendicular to said base frame structure, and a means for lifting said base frame structure;*

*ii) an adaptor means for attachment to said wellhead valve assembly; and*

*iii) a mounting plate assembly centrally attached to said base frame structure, said mounting plate assembly comprising a fixed plate and a removable split flange plate for further attachment to said adaptor means; and*

*b*) *attaching said adaptor means to a flange located atop said wellhead valve assembly;*

*c*) *lifting and positioning said portable personnel work platform centrally around said adaptor means;*

*d*) *securing said split flange plate to said adaptor means and said fixed plate; and*

*e*) providing a plurality of alternative adaptor means and selectively choosing the most suitable depending on wellhead flange configuration.

*17. A portable personnel work platform for attachment to a wellhead valve assembly comprising:*

*a*) *a tubular adapter fitting having a plurality of outwardly extending flanges, at least one of said outwardly extending flanges configured to be centrally mounted onto the flanges of a wellhead fitting;*

*b*) *a frame structure having floor grating and perimeter hand railing extending perpendicular to said frame structure; and*

*c*) *a mounting plate having a central opening, said mounting plate centrally attached to said frame structure whereby said frame structure emanates outwardly around the periphery of said mounting plate, said mounting plate centrally and removable attached directly to at least one of said outwardly extending flanges of said tubular adapter fitting whereby said frame structure emanates outwardly around the periphery of said tubular adapter fitting and is totally supported on said wellhead fitting by said tubular adapter fitting.*

*18. The portable personnel work platform for attachment to a wellhead valve assembly as recited in claim 17 wherein said central opening of said mounting plate is an opening sufficiently large enough for passing the flanges of said tubular adaptor fitting though said central opening of said mounting plate and further comprising a split flange plate, said split flange plate comprising:*

*a*) *a first removable flange plate having a semicircular cutout and a plurality of bolt holes arranged around said semicircular cutout, said first flange plate with said semicircular cutout and said bolt holes configured for attachment of said first removable flange plate to at least one of said outwardly extending flanges of said tubular adapter fitting and to said mounting plate of said frame structure; and*

*b*) *a second removable flange plate having a semicircular cutout and a plurality of bolt holes arranged around said semicircular cutout, said second flange plate with said semicircular cutout and said bolt holes being configured to abut said first removable flange plate and for attachment of said second removable flange plate to at least one of said outwardly extending flanges of said tubular adapter fitting and to said mounting plate of said frame structure adjacent to said first removable flange plate.*

*19. The portable personnel work platform for attachment to a wellhead valve assembly as recited in claim 18, further comprising*

*a*) *a plurality of railing posts attached perpendicularly to and surrounding said frame structure, said railing posts supporting said railing;*

*b*) *a pivotal davit for attaching a personnel safety lanyard; and*

*c*) *a lifting eye attached to at least one of said railing posts.*

*20. The portable personnel work platform for attachment to a wellhead valve assembly as recited in claim 18 wherein said tubular adapter fitting has at least three outwardly extending flanges.*

* * * * *